US008631585B2

(12) United States Patent
Pillot et al.

(10) Patent No.: US 8,631,585 B2
(45) Date of Patent: Jan. 21, 2014

(54) HOME LAUNDRY DRIER

(75) Inventors: Sergio Pillot, Pasiano di Pordenone (IT); Luciano Sartor, Conegliano (IT)

(73) Assignee: Electrolux Home Products Corporation N.V., Brussels (BE)

( * ) Notice: Subject to any disclaimer, the term of this patent is extended or adjusted under 35 U.S.C. 154(b) by 333 days.

(21) Appl. No.: 13/059,091

(22) PCT Filed: Jun. 19, 2009

(86) PCT No.: PCT/EP2009/004436

§ 371 (c)(1),
(2), (4) Date: Feb. 15, 2011

(87) PCT Pub. No.: WO2010/022811

PCT Pub. Date: Mar. 4, 2010

(65) Prior Publication Data

US 2011/0154675 A1 Jun. 30, 2011

(30) Foreign Application Priority Data

Aug. 29, 2008 (EP) ..... 08163341

(51) Int. Cl.
*F26B 21/00* (2006.01)
*D06F 58/22* (2006.01)

(52) U.S. Cl.
USPC ..... 34/82; 34/73

(58) Field of Classification Search
USPC ..... 34/82, 85, 72, 73, 467, 468, 480
See application file for complete search history.

(56) References Cited

U.S. PATENT DOCUMENTS

| | | | | |
|---|---|---|---|---|
| 2,211,812 | A * | 8/1940 | Colbert | 55/290 |
| 2,602,521 | A * | 7/1952 | Smith | 55/487 |
| 2,881,859 | A * | 4/1959 | Nutting | 55/352 |
| 3,999,304 | A | 12/1976 | Doty | |
| 5,216,822 | A * | 6/1993 | Madiedo | 34/82 |
| 6,016,610 | A | 1/2000 | Sears | |
| 6,671,977 | B2 * | 1/2004 | Beaumont | 34/79 |
| 7,020,986 | B1 | 4/2006 | Nakai et al. | |
| 2007/0169368 | A1 * | 7/2007 | Kim | 34/82 |

FOREIGN PATENT DOCUMENTS

| | | | |
|---|---|---|---|
| EP | 1 277 872 | | 1/2003 |
| EP | 1887127 | A1 * | 2/2008 |
| GB | 2 091 123 | | 7/1982 |
| GB | 2091123 | A * | 7/1982 |
| GB | 2 282 642 | | 5/2005 |

OTHER PUBLICATIONS

International Search Report mailed Aug. 31, 2009 in corresponding PCT/EP2009/004436.

* cited by examiner

*Primary Examiner* — Jiping Lu
(74) *Attorney, Agent, or Firm* — Banner & Witcoff, Ltd.

(57) ABSTRACT

A home laundry drier (1) having a casing (2), a laundry drying tub (3) housed inside the casing (2), and a hot-air generator (5) for circulating hot air into the drying tub (3) along a drying circuit (4). The drier (1) has an air filter (11) fitted stably, but easily removably, inside a pocket (12) located along the drying circuit (4). And the filter (11) has a first mesh (18) defining a mesh wall of the filter (11), and the openings (18*a*) of which are sized to filter fluff/fibers of a size greater than or equal to a first size threshold (S1); and a second mesh (19) defining another mesh wall of the filter (11), and the openings (19*a*) of which are sized to filter fluff/fibers of a size greater than a minimum second size threshold (S2) lower than the first size threshold (S1).

16 Claims, 5 Drawing Sheets

HOME LAUNDRY DRIER

BACKGROUND OF THE INVENTION

The present invention relates to a home laundry drier.

More specifically, the present invention relates to a home laundry drier of the type comprising a substantially parallelepiped-shaped casing; a cylindrical laundry drying tub fixed horizontally inside the casing, directly facing a laundry loading/unloading opening formed in the front face of the casing; and a door hinged to the front face of the casing to rotate to and from a work position closing the opening in the front face and sealing the cylindrical tub.

As is known, driers have a drying circuit connected to the drying tub; and a hot-air generator which generates and circulates the same air continually inside the drying tub, so as to continuously extract surplus moisture from the hot air issuing from the drying tub after flowing over the laundry inside the tub.

The hot-air generator comprises a condenser module for extracting moisture from the drying air; and a number of independent filters for filtering fibres and/or fluff released into the air by the laundry inside the drying tub, to prevent clogging of the component parts of the hot-air generator.

More specifically, some driers of the above type have two independent filters: a first fitted to the inlet of a first portion of the drying circuit, formed on the door and facing the loading/unloading opening of the tub; and a second normally fitted to a slit, which is formed in a peripheral edge of the loading/unloading opening, is positioned facing the outlet of the first portion, and defines the inlet of a second portion of the drying circuit adjacent to the first portion.

As is known, each filter comprises a mesh sized to trap fluff/fibres, while allowing sufficient minimum airflow for the drying circuit to operate.

In driers of the above type, the maximum size of the filters depends on the filter-seating spaces in the drier.

More specifically, the first filter must be sized for assembly to the door, so its maximum size must be smaller than the size of the door; while the size of the second filter depends on the size of the slit to which it is fitted. This restriction, together with that of ensuring minimum airflow, poses a limit to the extent to which the mesh size can be reduced. As a result, the openings in the mesh only provide for partly filtering, i.e. relatively large-size, fluff/fibres, whereas smaller fluff/fibres pass freely through the filter and deposit on the condenser module.

To eliminate the above drawback, driers of the above type feature a condenser module that can be extracted from the casing to allow the user to periodically clean off deposited fluff/fibres.

This solution, however, is complicated in design and expensive to produce, on account of the pull-out condenser module requiring an extra door hinged to the casing, and electronic safety devices for indicating opening/closing of the door, with all the drawbacks this entails in terms of manufacture and higher production cost of the drier.

Other driers are known to employ a third filter located along the drying circuit and directly facing the condenser module to intercept airflow into the module. More specifically, the condenser module is housed stably inside a respective seat inside the casing, normally beneath the drying tub; and the third filter is housed in a drawer, also located beneath the drying tub, and which can be pulled out of the casing to allow the user to clean the filter.

This solution has the drawback of the additional third filter bringing about a far from negligible increase in the manufacturing cost of the drier.

SUMMARY OF SELECTED INVENTIVE ASPECTS

It is an object of the present invention to provide a home laundry drier featuring a single air filter designed to also filter very small fluff/fibres.

According to the present invention, there is provided a home laundry drier, as claimed in claim 1 and preferably, though not necessarily, in any one of the Claims depending directly or indirectly on claim 1.

BRIEF DESCRIPTION OF THE DRAWINGS

A non-limiting embodiment of the present invention will be described by way of example with reference to the accompanying drawings, in which.

DETAILED DESCRIPTION OF EXAMPLE EMBODIMENTS

Figure 1:
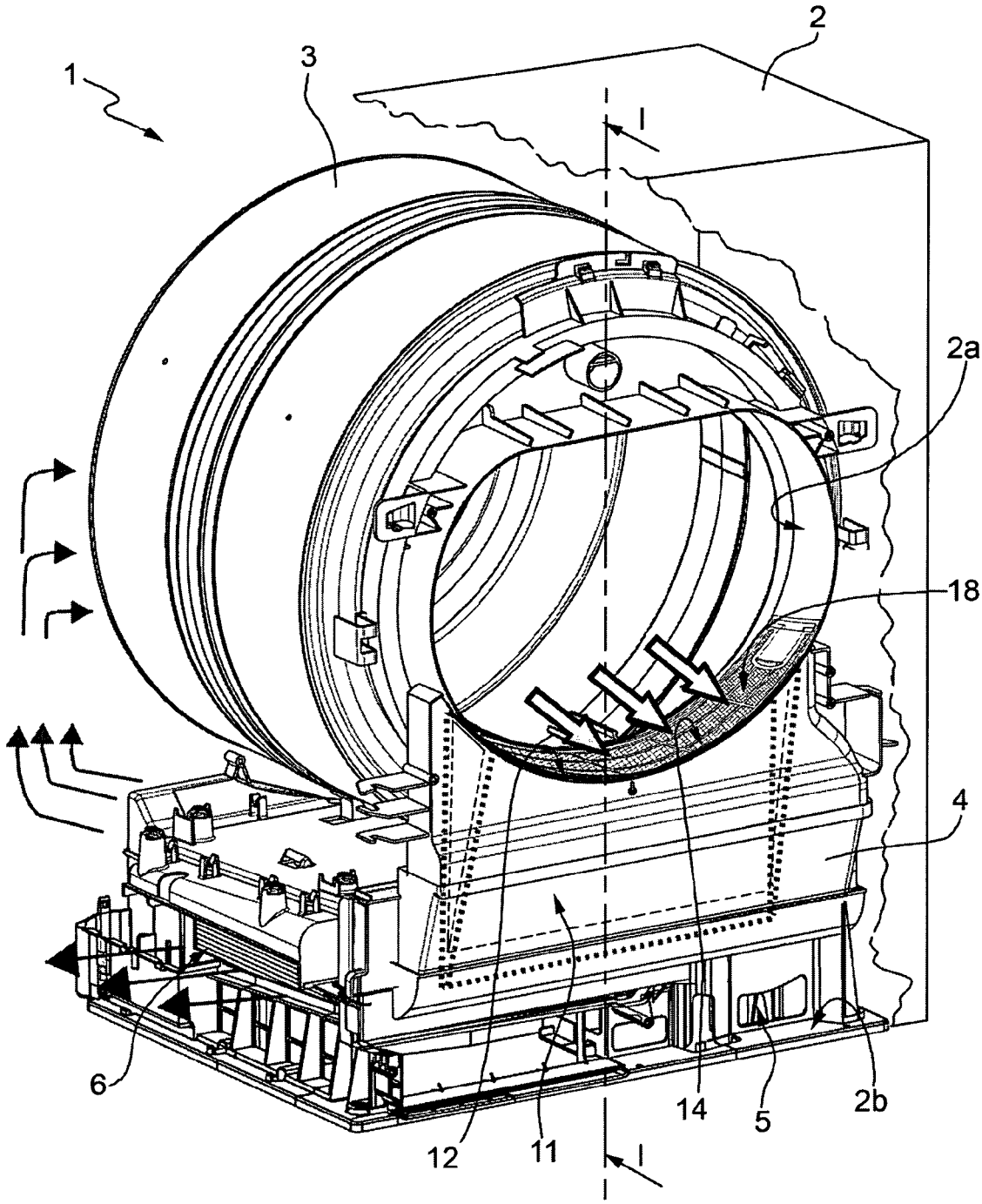
FIG. 1 shows a partly sectioned view in perspective, with parts removed for clarity, of a laundry drier in accordance with the teachings of the present invention.
Figure 2:
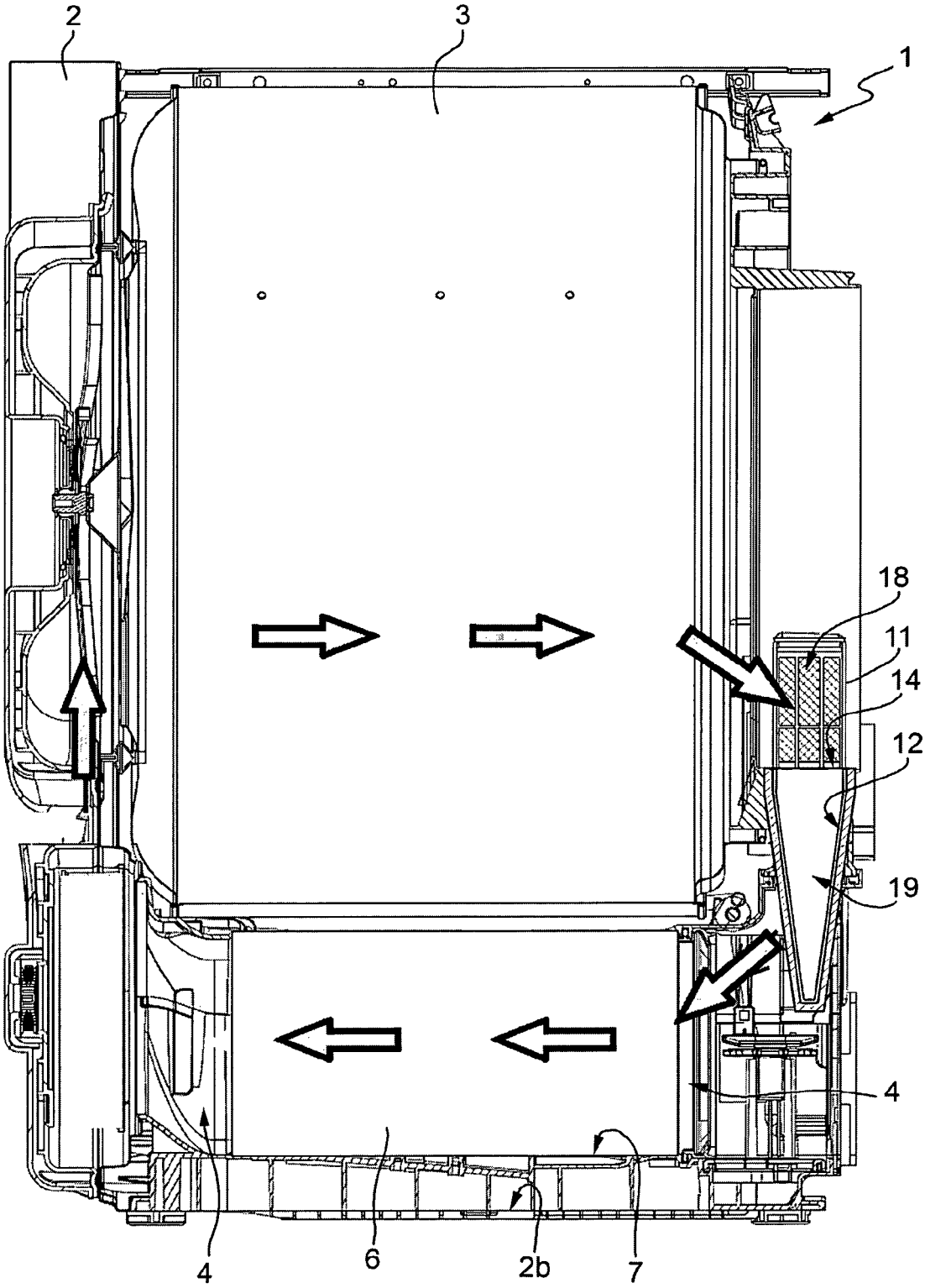
FIG. 2 shows a section of the drier along line I-I in FIG. 1.

With reference to FIGS. 1 and 2, number 1 indicates as a whole a home laundry drier substantially comprising a preferably, though not necessarily, parallelepiped-shaped casing 2; a preferably, though not necessarily, cylindrical laundry drying chamber or tub 3 fixed substantially horizontally inside casing 2 and directly facing a laundry loading/unloading opening 2*a* formed in the front face of casing 2; and a door (not shown) hinged to the front face of casing 2 to rotate to and from a work position closing opening 2*a* in the front face to seal drying tub 3.

Drier 1 comprises a drying circuit 4 connected at the ends to drying tub 3; and a hot-air generator assembly 5 which generates and circulates the same air continually along drying circuit 4 into drying tub 3, so as to continuously extract surplus moisture from the hot air issuing from drying tub 3 after flowing over the laundry inside drying tub 3.

Figure 3:
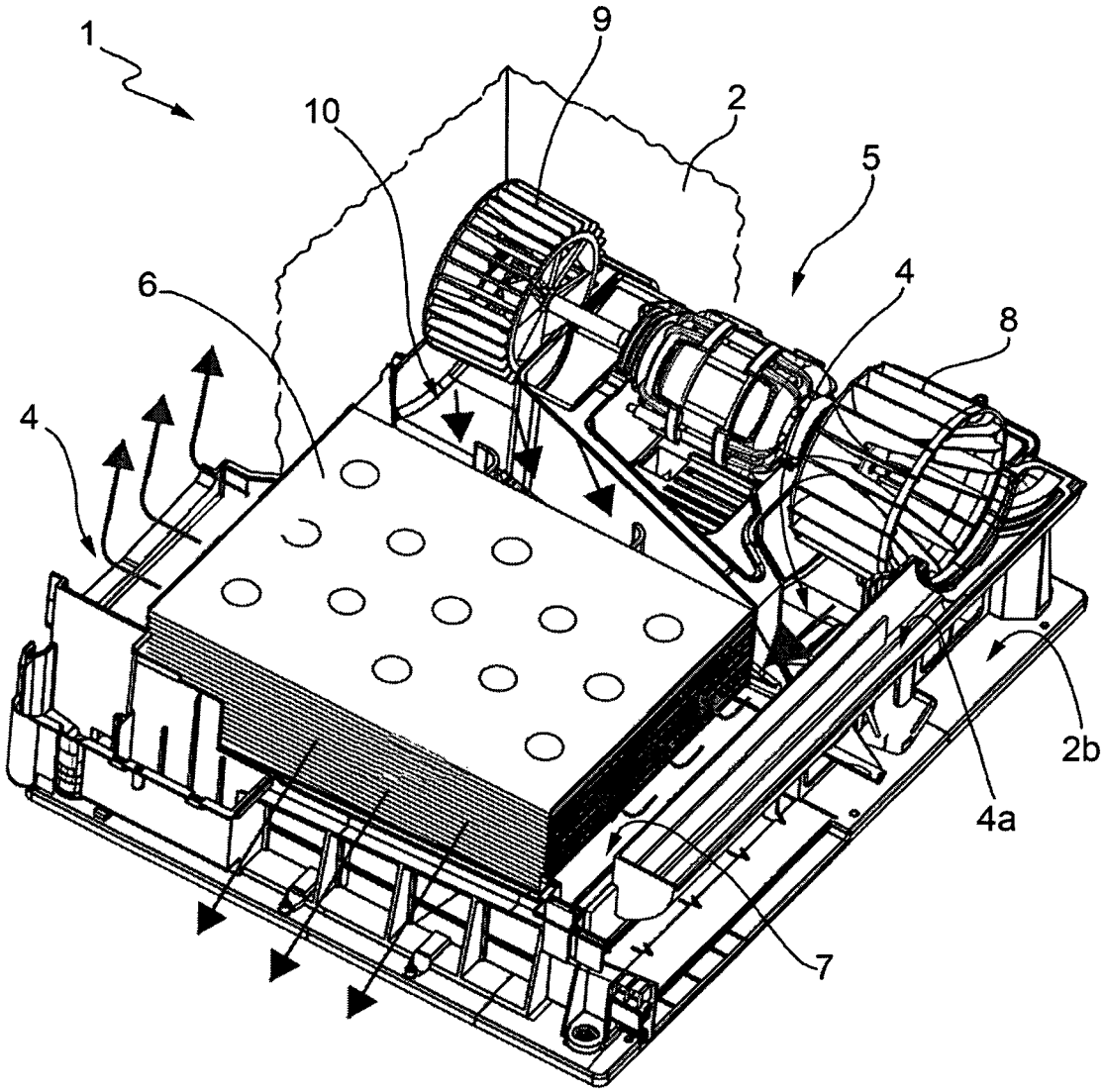
FIG. 3 shows a view in perspective of the hot-air generator assembly of the FIG. 1 drier.

More specifically, in the FIGS. 2 and 3 example, hot-air generator assembly 5 comprises: a condenser module 6 housed stably inside a seat 7 formed along drying circuit 4, to extract moisture from the air flowing through it; a centrifugal fan 8 located downstream from a first portion 4*a* of drying circuit 4 to feed the air from drying tub 3 into condenser module 6; and a centrifugal fan 9 located along a cooling circuit 10 to cool condenser module 6 and so condense the moisture in the hot air flowing through it.

Unlike known driers, drier 1 also comprises an air filter 11 fitted stably, but easily removably, inside a pocket 12 formed on a wall of casing 2, and located along first portion 4*a* of drying circuit 4, between centrifugal fan 8 and drying tub 3.

More specifically, pocket 12 is formed on the front wall of casing 2, and has an outer slit 14 formed on a peripheral edge 15 surrounding laundry loading/unloading opening 2*a*; and filter 11 is fitted inside pocket 12, and has at least two meshes, through which flows the moisture-laden hot air flowing from drying tub 3 into condenser module 6.

Figure 4:
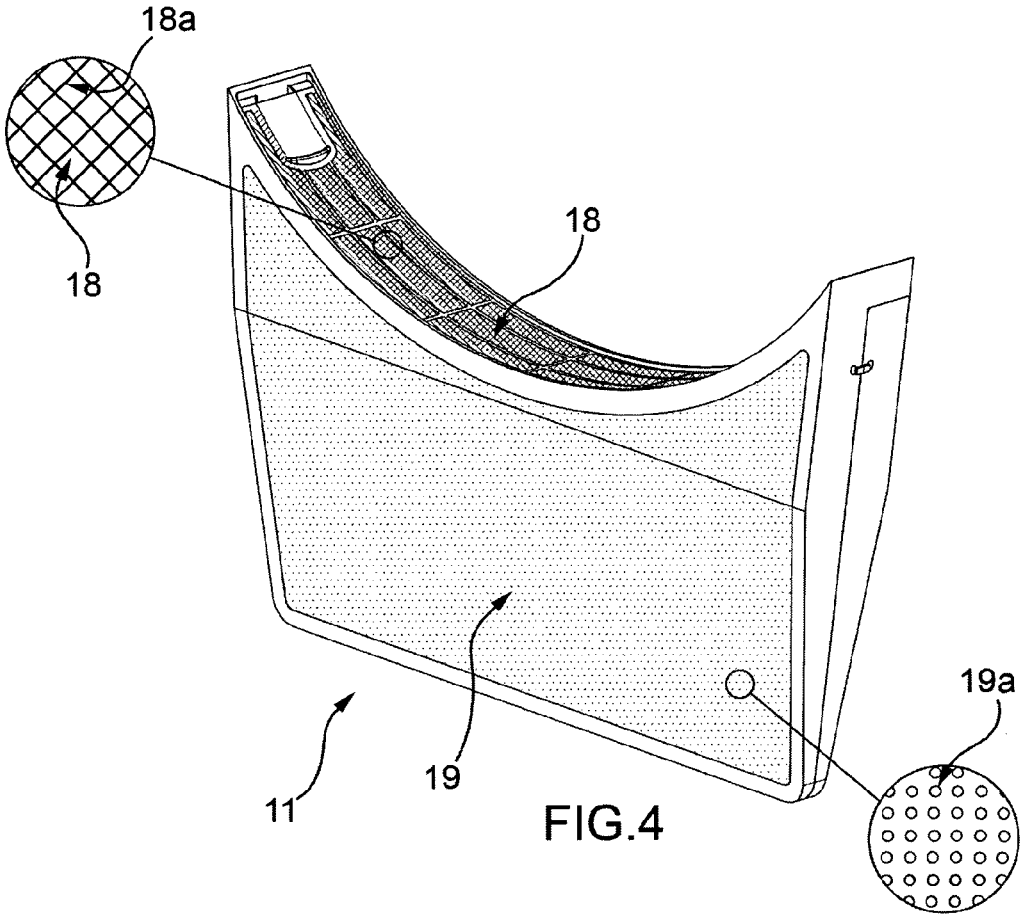
FIG. 4 shows a view in perspective of the filter used in the FIG. 1 drier.
Figure 5:
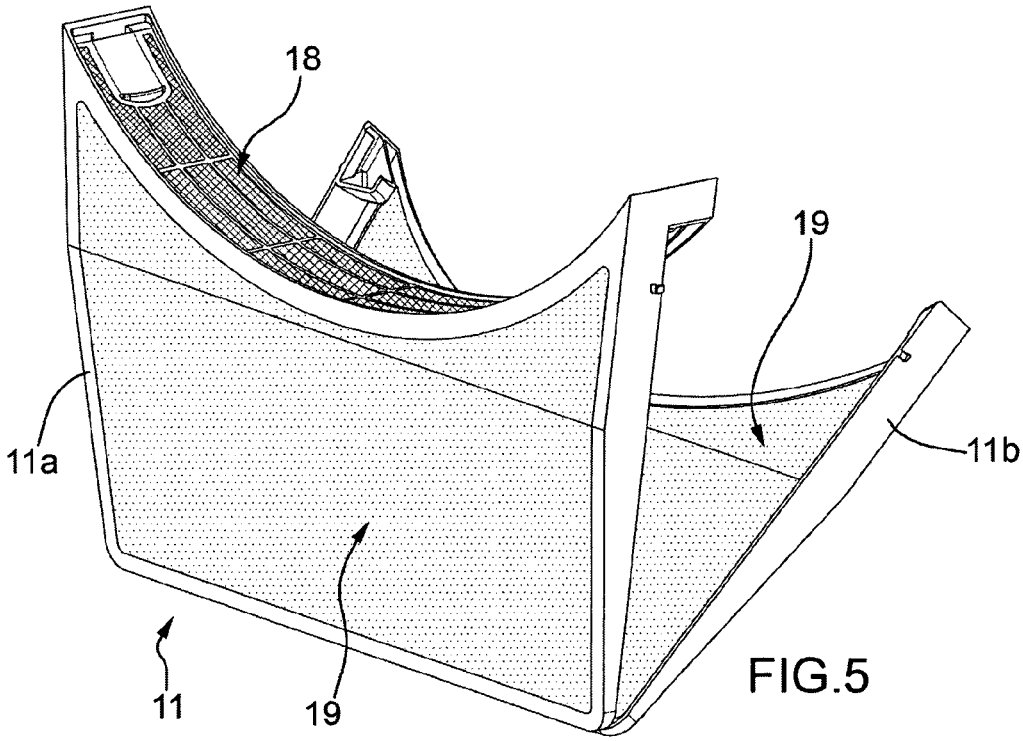
FIG. 5 shows a view in perspective of the FIG. 4 filter in an open position.
Figure 6:
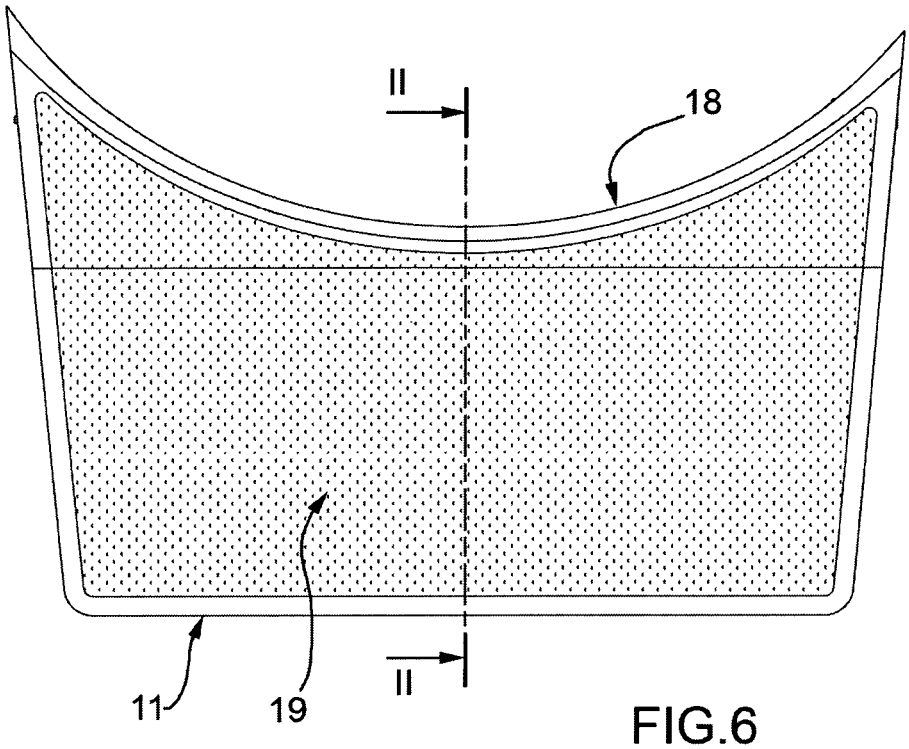
FIG. 6 shows a schematic front view of the filter used in FIG. 1 drier.
Figure 7:
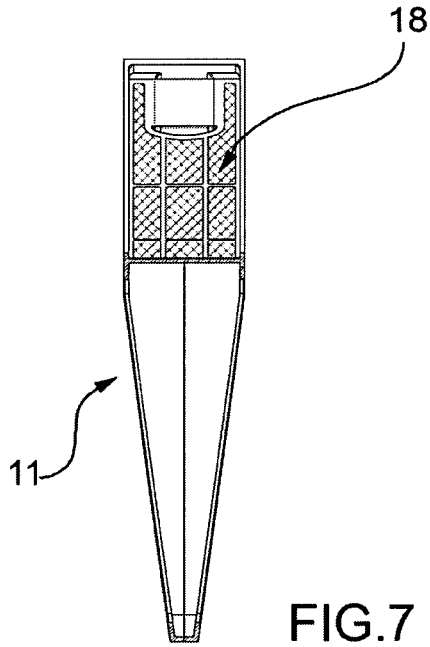
FIG. 7 shows a section of the filter along line II-II in FIG. 6.

More specifically, one mesh of filter 11—indicated 18 in FIGS. 4 and 5—has openings 18*a* sized to filter fluff/fibres of a size greater than or equal to a first size threshold S1; and a second mesh—indicated 19 in FIG. 4—has openings 19*a* sized to filter fluff/fibres of a size greater than a minimum second size threshold S2 lower than first size threshold S1.

In the FIGS. 4, 5, 6 and 7 examples, filter 11 has a preferably, though not necessarily, triangular cross section; and first and second meshes 18 and 19 are made of plastic, such as polyester, and are positioned on filter 11 to define, respectively, the top wall of filter 11, through which air flows into filter 11, and the opposite major lateral walls of filter 11, through which air flows out of filter 11.

More specifically, first mesh 18 is characterized by a density of openings 18*a* of 12/cm$^2$, in which each opening 18*a* is sized to filter fluff/fibres of a size greater than or equal to a first size threshold S1 of roughly 700 μm; and second mesh 19 is characterized by a density of openings 19*a* of 36/cm$^2$, in which each opening 19*a* is sized to filter fluff/fibres of a size greater than or equal to a second size threshold S2 of roughly 180 μm.

In the FIGS. 4, 5, 6 and 7 embodiment, filter 11 comprises two half-shells 11*a* and 11*b* joined to allow the user to open filter 11 and clean off the fluff/fibres clinging to second mesh 19. More specifically, a first half-shell 11*a* comprises one lateral wall of filter 11 having second mesh 19; and the top wall of filter 11 having first mesh 18. And a second half-shell 11*b* comprises the other lateral wall of filter 11 having second mesh 19, and is designed to fit firmly, but easily removably, to first half-shell 11*a*.

In the FIG. 5 example, the two half-shells 11*a*, 11*b* are hinged to each other at the bottom edge of filter 11, so filter 11 can be opened.

In the FIG. 1 example, pocket 12 is designed to house filter 11. More specifically, pocket 12 is sized to extend downwards from slit 14 to first portion 4*a* of drying circuit 4.

In the FIG. 1 example, seat 7 stably housing condenser module 6 is formed on the base 2*a* of drier 1, beneath drying tub 3; and first portion 4*a* of drying circuit 4 is positioned facing the front wall of casing 2, beneath drying tub 3, and substantially facing condenser module 6. This location of condenser module 6 has the advantage of extending pocket 12 vertically downwards to base 2*a*, thus increasing the height of filter 11 and enabling a convenient reduction in the size of openings 19*a*.

In actual use, the fluff/fibres in the air from the drying tub are retained by first mesh 18, which filters fluff/fibres larger than first size threshold S1, and lets through any other smaller fluff/fibres in the air.

At this point, the fluff/fibres encounter openings 19*a* of second mesh 19 of filter 11, which retain fluff/fibres larger than second size threshold S. When the drier is off, the user can extract filter 11 from pocket 12 and clean the accumulated fluff/fibres off the first and second mesh. More specifically, the user may advantageously open/split the two half-shells 11*a*, 11*b* to clean the accumulated fluff/fibres off second mesh 19 inside filter 11.

The advantages of drier 1 as described above are obvious: by oversizing the pocket, the filter can be made larger, and therefore with very small openings, while still guaranteeing the required minimum airflow. The openings in second mesh 19 are therefore able to more effectively filter both relatively large and small-size fluff/fibres, thus keeping the condenser module cleaner.

Clearly, changes may be made to drier 1 as described herein without, however, departing from the scope of the present invention.

The invention claimed is:

1. A home laundry drier comprising a casing; a laundry drying tub housed inside said casing; and a hot-air generator for circulating hot air into said drying tub along a drying circuit;

said drier comprising an air filter fitted stably, but easily removably, inside a pocket located along said drying circuit; said filter comprising a first mesh located on a wall of said filter, and which has a number of first openings, each sized to filter fluff/fibres of a size greater than or equal to a first size threshold; and a second mesh located on another wall of the filter and having second openings, each sized to filter fluff/fibres of a size greater than a minimum second size threshold lower than said first size threshold;

wherein:

said hot-air generator comprises a condenser module located stably beneath said drying tub, on a base of said casing; said drying circuit comprising a first portion for feeding air from said drying tub into said condenser module, and which extends substantially facing said base and said condenser module; and said pocket extending vertically to said first portion of said drying circuit from an outer passage formed on a peripheral edge surrounding an opening by which to load/unload laundry in/out of said drying tub; and said filter comprises two connected shells portions; a first shell portion comprising a lateral wall of the filter having said second mesh, and a top wall of the filter having said first mesh; and a second shell portion comprising a lateral wall of the filter having said second mesh, and being designed to fit stably, but easily removably, to said first shell portion.

2. A drier as claimed in claim 1, wherein said first mesh has a density of said openings of roughly 12/cm$^2$.

3. A drier as claimed in claim 2, wherein each said opening of said first mesh is sized to filter fluff/fibres of a size greater than or equal to a first size threshold of roughly 700 μm.

4. A drier as claimed in claim 3, wherein said second mesh has a density of said openings of roughly 36/cm$^2$.

5. A drier as claimed in claim 4, wherein each said opening of said second mesh is sized to filter fluff/fibres of a size greater than or equal to a second size threshold of roughly 180 μm.

6. A drier as claimed in claim 3, wherein each said opening of said second mesh is sized to filter fluff/fibres of a size greater than or equal to a second size threshold of roughly 180 μm.

7. A drier as claimed in claim 2, wherein said second mesh has a density of said openings of roughly 36/cm$^2$.

8. A drier as claimed in claim 7, wherein each said opening of said second mesh is sized to filter fluff/fibres of a size greater than or equal to a second size threshold of roughly 180 μm.

9. A drier as claimed in claim 2, wherein each said opening of said second mesh is sized to filter fluff/fibres of a size greater than or equal to a second size threshold of roughly 180 μm.

10. A drier as claimed in claim 1, wherein each said opening of said first mesh is sized to filter fluff/fibres of a size greater than or equal to a first size threshold of roughly 700 μm.

11. A drier as claimed in claim 10, wherein said second mesh has a density of said openings of roughly 36/cm$^2$.

12. A drier as claimed in claim 11, wherein each said opening of said second mesh is sized to filter fluff/fibres of a size greater than or equal to a second size threshold of roughly 180 μm.

13. A drier as claimed in claim 10, wherein each said opening of said second mesh is sized to filter fluff/fibres of a size greater than or equal to a second size threshold of roughly 180 μm.

14. A drier as claimed in claim 1, wherein said second mesh has a density of said openings of roughly 36/cm$^2$.

15. A drier as claimed in claim 14, wherein each said opening of said second mesh is sized to filter fluff/fibres of a size greater than or equal to a second size threshold of roughly 180 μm.

16. A drier as claimed in claim 1, wherein each said opening of said second mesh is sized to filter fluff/fibres of a size greater than or equal to a second size threshold of roughly 180 μm.

* * * * *